United States Patent [19]

Batliwalla et al.

[11] Patent Number: 4,719,335

[45] Date of Patent: Jan. 12, 1988

[54] DEVICES COMPRISING CONDUCTIVE POLYMER COMPOSITIONS

[75] Inventors: Neville S. Batliwalla, Foster City; Michael C. Jones, Fremont; Ravinder K. Oswal, Union City; Jeff Shafe, Redwood City; Bernadette A. Trammell, Menlo Park, all of Calif.

[73] Assignee: Raychem Corporation, Menlo Park, Calif.

[21] Appl. No.: 51,439

[22] Filed: May 19, 1987

Related U.S. Application Data

[63] Continuation of Ser. No. 820,276, Jan. 17, 1986, abandoned, which is a continuation-in-part of Ser. No. 780,524, Sep. 26, 1985, abandoned, Ser. No. 650,918, Sep. 14, 1984, abandoned, Ser. No. 650,919, Sep. 14, 1984, abandoned, Ser. No. 735,409, May 17, 1985, abandoned, and Ser. No. 735,408, May 17, 1985, abandoned, which is a continuation-in-part of Ser. No. 663,014, Oct. 19, 1984, abandoned, which is a continuation-in-part of Ser. No. 650,920, Sep. 14, 1984, abandoned, said Ser. No. 780,524, is a continuation of Ser. No. 573,099, Jan. 23, 1984, abandoned.

[51] Int. Cl.[4] ..... H05B 3/34

[52] U.S. Cl. ..... 219/528

[58] Field of Search ..... 219/511, 528, 538, 553, 219/505, 549, 522; 338/20, 22, 211, 212

[56] References Cited

U.S. PATENT DOCUMENTS

| | | | |
|---|---|---|---|
| 2,529,914 | 6/1950 | Challenner | 219/528 |
| 2,745,942 | 5/1956 | Cohen | 219/46 |
| 3,022,412 | 9/1958 | Waters | 219/46 |
| 3,057,952 | 10/1962 | Gordon et al. | 219/549 |
| 3,257,498 | 6/1966 | Kahn | 174/75 |
| 3,287,684 | 11/1966 | Armbruster, Jr. | 338/211 |
| 3,299,253 | 1/1967 | Lawson, Jr. | 219/385 |
| 3,387,248 | 6/1968 | Rees | 338/211 |
| 3,522,415 | 8/1970 | Eisler | 219/528 |
| 3,535,494 | 10/1970 | Armbruster | 219/528 |
| 3,582,968 | 6/1971 | Buiting et al. | 219/300 |
| 3,584,198 | 6/1971 | Doi et al. | 219/549 |
| 3,657,516 | 4/1972 | Fujihara | 219/345 |
| 3,781,526 | 12/1973 | Damron | 219/538 |
| 3,793,716 | 2/1974 | Smith-Johannsen | 29/611 |
| 3,808,403 | 4/1974 | Kanaya et al. | 219/528 |
| 3,859,504 | 1/1975 | Motokawa et al. | 219/345 |
| 3,861,029 | 1/1975 | Smith-Johannsen et al. | 29/611 |

(List continued on next page.)

FOREIGN PATENT DOCUMENTS

| | | |
|---|---|---|
| 0038718 | 10/1981 | European Pat. Off. . |
| 0087884 | 9/1983 | European Pat. Off. . |
| 0098647 | 1/1984 | European Pat. Off. . |
| 2160358 | 6/1973 | Fed. Rep. of Germany . |
| 2231086 | 1/1974 | Fed. Rep. of Germany . |
| 2946842 | 5/1981 | Fed. Rep. of Germany . |
| 2069719 | 9/1971 | France . |
| 2116818 | 7/1972 | France . |
| 2171355 | 9/1973 | France . |
| 2528253 | 12/1983 | France . |
| 838478 | 6/1960 | United Kingdom . |
| 838497 | 6/1960 | United Kingdom . |
| 984541 | 2/1965 | United Kingdom . |
| 1383162 | 2/1975 | United Kingdom . |

*Primary Examiner*—Donald A. Griffin

*Attorney, Agent, or Firm*—Timothy H. P. Richardson; Herbert G. Burkard

[57] ABSTRACT

A number of improvements to electrical devices, particularly sheet heaters, comprising conductive polymer compositions, are provided. The preferred heater has the following features (a) it comprises a laminar resistive element and a plurality of electrodes which are so positioned that the predominant direction of current flow is parallel to the faces of the laminar element, (b) it comprises a laminar insulating element adjacent to but not secured to the electrodes and the resistive element; (c) it comprises a metallic foil, which acts as a ground plane and is positioned adjacent the insulating element but is not secured thereto; (d) it comprises a dielectric layer intimately bonded to the resistive element and to the electrodes.

The invention also provides an electrical device comprising first and second members having different resistivities, and a thin contact layer of intermediate resistivity positioned between the first and second members.

13 Claims, 12 Drawing Figures

U.S. PATENT DOCUMENTS

| | | | |
|---|---|---|---|
| 3,878,362 | 4/1975 | Stinger | 219/528 |
| 3,900,654 | 8/1975 | Stinger | 428/214 |
| 4,034,207 | 7/1977 | Tamada et al. | 219/517 |
| 4,037,082 | 7/1977 | Tamada et al. | 219/541 |
| 4,055,526 | 10/1977 | Kiyokawa et al. | 264/22 |
| 4,149,066 | 4/1975 | Niibe | 219/505 |
| 4,162,395 | 7/1979 | Kobayashi | 219/367 |
| 4,177,446 | 12/1979 | Diaz | 338/212 |
| 4,177,785 | 12/1979 | Sundeen | 123/179 |
| 4,223,209 | 9/1980 | Diaz | 219/549 |
| 4,237,441 | 12/1980 | van Konynenburg et al. | 338/22 |
| 4,242,573 | 12/1980 | Batliwalla | 219/528 |
| 4,245,149 | 1/1981 | Fairlie | 219/528 |
| 4,250,398 | 2/1981 | Ellis et al. | 219/345 |
| 4,307,290 | 12/1981 | Bloore et al. | 219/528 |
| 4,323,726 | 4/1982 | Criss et al. | 174/68.5 |
| 4,330,703 | 5/1982 | Horsma et al. | 219/553 |
| 4,331,860 | 5/1982 | Roller et al. | 219/544 |
| 4,341,949 | 7/1982 | Steiner et al. | 219/553 |
| 4,348,584 | 9/1982 | Gale et al. | 219/549 |
| 4,385,226 | 5/1983 | Sauer | 219/522 |
| 4,388,607 | 6/1983 | Toy et al. | 338/22 |
| 4,413,174 | 11/1983 | Ting | 219/511 |
| 4,421,582 | 12/1983 | Horsma et al. | 156/86 |
| 4,426,339 | 1/1984 | Kamath et al. | 264/22 |
| 4,429,216 | 1/1984 | Brigham | 219/528 |
| 4,481,498 | 11/1984 | McTavish et al. | 338/20 |
| 4,485,297 | 11/1984 | Grise et al. | 219/528 |
| 4,542,365 | 9/1985 | McTavish et al. | 338/20 |
| 4,549,161 | 10/1985 | McTavish et al. | 338/20 |

DEVICES COMPRISING CONDUCTIVE POLYMER COMPOSITIONS

BACKGROUND OF THE INVENTION

Cross Reference to Related Applications

This application is a continuation of our copending commonly assigned application Ser. No. 820,276 filed Jan. 17, 1986, which is a continuation-in-part of our copending commonly assigned applications Ser. Nos. 780,524 filed Sept. 26, 1985, 650,918 filed Sept. 14, 1984, 735,408 filed May 17, 1985, 650,919 filed Sept. 14, 1984 and 735,409 filed May 17, 1985. U.S. Ser. No. 780,524 is itself a continuation of copending commonly assigned application Ser. No. 573,099 filed Jan. 23, 1984. U.S. Ser. No. 735,408 is itself a continuation-in-part of copending, commonly assigned application Ser. No. 663,014 filed Oct. 19, 1984, which is in turn a continuation-in-part of copending, commonly assigned application Ser. No. 650,920 filed Sept. 14, 1984. Each of these commonly assigned applications has now been abandoned. The entire disclosure of each of these commonly assigned applications is incorporated herein by reference.

FIELD OF THE INVENTION

This invention relates to electrical devices, particularly sheet heaters which contain conductive polymer compositions.

INTRODUCTION TO THE INVENTION

It is known that polymers, including crystalline polymers, can be made electrically conductive by dispersing therein suitable amounts of carbon black or another finely divided conductive filler. Some conductive polymers exhibit what is known as PTC (positive temperature coefficient) behavior. The terms "composition exhibiting PTC behavior" and "PTC composition" are used in this specification to denote a composition which has an $R_{14}$ value of at least 2.5 or an $R_{100}$ value of at least 10, and preferably both, and particularly one which has an $R_{30}$ value of at least 6, where $R_{14}$ is the ratio of the resisitivities at the end and the beginning of a 14° C. range, $R_{100}$ is the ratio of the resistivities at the end and the beginning of a 100° range, and $R_{30}$ is the ratio of the resistivities at the end and the beginning of a 30° C. range.

Electrical devices comprising conductive polymer elements are well-known, including in particular sheet heaters which comprise a laminar resistive heating element which is composed of a conductive polymer, i.e. a mixture of a conductive filler and an organic polymer (this term being used to include polysiloxanes), the filler being dispersed in, or otherwise held together by, the organic polymer, and may exhibit PTC behavior, thus rendering the heater self-regulating. In some sheet heaters, the electrodes are positioned on one face of the resistive element, e.g. by printing a conductive ink onto the heating element.

It is also known to provide sheet heaters (e.g. for use in hazaradous areas) with a ground plane in the form of a metallic, e.g. cooper, mesh sheet secured to the exterior of the insulating jacket.

SUMMARY OF THE INVENTION

We have discovered a number of new sheet heaters, with improved properties.

In a first aspect the present invention provides a heater which comprises (1) a laminar element which is at least 0.002 inch thick and is composed of a conductive polymer composition comprising an organic polymer and, dispersed in the polymer, a particulate conductive filler;

(2) a plurality of electrodes, at least two of which can be connected to a source of electrical power to cause current to pass through the laminar element, and which are dimensioned and positioned so that (a) when current passes between the electrodes, a substantial component (usually at least 75%, preferably at least 90%, particularly at least 95%) of the current is parallel to the faces of the laminar element, and (b) the ratio of the average width of the electrodes, measured parallel to the faces of the laminar element, to the average distance between adjacent electrodes between which current passes, measured parallel to the faces of the laminar element, is at least 0.1:1.

We have found that excellent conductive polymer sheet heaters according to the first aspect of the invention can be prepared by shaping, preferably melt-shaping, the conductive polymer into a sheet, and simultaneously or subsequently securing within the sheet and/or on one or both surfaces of the sheet, a plurality of electrodes which are spaced-apart from each other so that the predominant direction of current flow between the electrodes is substantially parallel to the face of the conductive polymer sheet. The heater is preferably a self-regulating heater which comprises ribbon-shaped electrodes on a surface of a melt-shaped PTC conductive polymer sheet. The size and separation of the electrodes are important in determining the properties of the resulting heater, especially when the conductive polymer exhibits PTC behavior. Thus in preferred embodiments of the first aspect of the invention, the electrodes appear to act both as current carriers and as heat sinks in a way which minimizes the formation of "hot-lines" (i.e. narrow areas over which there is a high voltage gradient) in the PTC element.

A second aspect of the invention provides an electrical sheet heater which comprises (1) a laminar heating element which comprises (a) a laminar resistive element having a first face and a second face, and (b) at least two electrodes which are positioned on the first face of the resistive element and which can be connected to a source of electrical power to cause current to pass through the resistive element and cause resistive heating thereof, and (2) a first laminar insulating element which is adjacent to the electrodes and the first face of the resistive element but is not secured to the electrodes.

We have discovered that when the electrodes of a sheet heater are positioned on a face of the resistive element, serious difficulties can arise if the insulating element on that side of the heater is secured firmly thereto in the known ways, e.g. through the use of an adhesive or a melt bond. Thus we have found in the invention according to the second aspect of the invention that if the electrodes are secured to the insulating layer and to the resistive element, the bond to the insulating element can cause the electrode to become detached from the resistive element, resulting in loss of power and/or dangerous short circuits. Such detachment can occur, for example, as a result of flexing the heater (if it is flexible) and/or as a result of thermal cycling which causes different parts of the heater to expand and contract at different rates. The present invention provides improved sheet heaters which mitigate or overcome these difficulties by using an insulating layer which is adjacent to the electrodes and the surface of the resistive element bearing the electrodes, but which is not secured to the electrodes and preferably is not secured to the electrodes or to the resistive element. An added benefit of such heaters is that the separation between the resistive element and the insulation provides a thermal barrier such that heat can be directed towards the substrate to be heated, which is preferably placed on the opposite side from the electrodes. Insulation of the heating element is normally completed by a second insulating layer which is adjacent the surface of the resistive element which does not bear the electrodes.

A third aspect of the invention provides an electrical sheet heater which is suitable for use in hazardous areas and which comprises (1) a laminar heating element,
(2) an insulating jacket which surrounds the heating element, and
(3) a laminar metallic member which
  (i) provides a ground plane for the heater;
  (ii) is separated from the heating element and by the insulating jacket, and
  (iii) is adjacent to the insulating jacket but is not secured thereto.

The use of metallic mesh sheets in the past has resulted from the need to accommodate relative movement of the ground plane and the insulating jacket as a result of flexing or of different expansions on thermal cycling. However, even mesh sheets are not entirely satisfactory for this purpose unless the mesh is at an angle of 45° to the axis of the heater, and such mesh material is expensive and not readily available in long lengths.

We have now discovered, according to the third aspect of the invention, that a laminar metallic member of any kind, including in particular a continuous metallic foil, can be satisfactorily employed to provide a ground path in a sheet heater, providing that the member is attached to the heater in a way which permits relative movement of the member and the adjacent parts of the heater. For example, the metallic member can be maintained adjacent to the insulating jacket, but not secured thereto, by means of a polymeric sheet which is secured to the insulating jacket along marginal portions thereof, thus providing a pocket in which the metallic member is loosely held. The use of a continuous metal foil has the additional advantages of reducing cost of materials, providing 100% ground coverage, and providing improved performance by reason of its improved thermal conductivity.

A fourth aspect of the present invention provides an electrical sheet heater which comprises:

(1) a laminar resistive element which is composed of a conductive polymer composition which comprises an organic polymer, and dispersed in the polymer, a particulate filler;
(2) a plurality of electrodes at least two of which can be connected to a source of electrical power to cause current to pass through the laminar element, and which are dimensioned and positioned so that when current passes between the electrodes, a substantial proportion of the current is parallel to the faces of the laminar element; and
(3) a dielectric layer positioned over at least part of the electrodes, the dielectric layer having been applied directly onto the electrodes in liquid form, and then solidified so that a solidified layer is formed having a first surface which is intimately bonded to at least part of the electrodes, and a second surface, facing away from the electrodes, with the proviso that if another member is bonded to the second surface of the solidified dielectric layer, at least one of the following conditions is satisfied (a) the peel strength of the bond between the said another member and the second surface of the dielectric layer is less than the peel strength of the bond between the first surface of the dielectric layer and the electrode; and (b) the peel strength of the bond between the said another member and the second surface of the dielectric layer is less than 3 lbs. per linear inch at 20° C.

In our work with laminar heaters comprising interdigitated electrodes positioned on a surface of a laminar resistive element, we have found that conventional means for insulating the electrode-bearing surface are not satisfactory. For example insulating layers secured by means of an adhesive can cause the electrodes to separate from the resistive element. One solution to this difficulty is to use the invention according to the second aspect of the invention, i.e. an insulating layer which is not secured to the electrode-bearing surface; however, the use of such dissociated insulation has the disadvantage that, if there is even a very small hole in the insulation, moisture entering through the hole can accumulate under the insulation and cause a short between the electrodes.

We have discovered, according to the fourth aspect of the invention, that the problems outlined above can be mitigated by forming a dielectric layer on the electrode-bearing surface, by applying to the surface a composition which is liquid when it is applied and which is solidified on the surface so that it is intimately bonded to at least part of the electrodes, preferably also to at least part of the resistive element and especially to the surface as a whole.

We have also unexpectedly and advantageously found that the applied dielectric layer provides improved electrical properties, in particular improved electrical safety, eliminating, or at least reducing, the possibility of sparking and burning if one of the current carrying electrodes is inadvertently cut or the current path otherwise broken.

A fifth aspect of the present invention provides an electrical device which comprises:

(1) a resistive element composed of a first material which has a resistivity at 23° C. of 1 to 500,000 ohm.cm;
(2) a contact layer which is directly bonded to a surface of the resistive element, and is composed of a second conductive material having a resistivity at 23° C. which is less than the resistivity at 23° C. of the first material; and
(3) a further member which is composed of a third conductive material having a resistivity at 23° C. which is less than the resistivity at 23° C. of the second material, preferably a metal, said further member being in direct physical contact with the contact layer and being maintained in such contact substantially only by means of pressure over a connection area which is at least 0.5 square inch in area or which has at least one dimension greater than 1 inch, the components of the device being positioned such that the device can be connected to a source of electrical power so that an electrical path exists from the further member to the resistive element through the contact layer.

With such an arrangement good electrical contact between the resistive element and the further member, that is the lowest resistivity member, can be achieved merely by pressing the further member against the contact layer, even when the connection area is large and/or long and even when the pressure is sufficiently low to allow the further member to be moved relative to the contact layer. In one preferred embodiment the further member provides a connection means for connection, for example to a power supply.

A sixth aspect of the present invention provides an electrical device which comprises:

(1) a resistive element composed of a first conductive material, which has a resistivity at 23° C. of 1 to 500,000 ohm.cm;

(2) a contact layer which is supported by and bonded to a surface of the resistive element, and is composed of a second conductive material having a resistivity at 23° C. which is less than the resistivity at 23° C. of the first material; and (3) a further member which is composed of a third conductive material having a resistivity at 23° C. greater than $1\times10^{-5}$ ohm.cm but less than the resistivity at 23° C. of the second material, the further member being in direct physical contact with, and preferably being bonded to, the contact layer, the components of the device being positioned such that the device can be connected to a source of electrical power so that an electrical path exists from the further member to the resistive element through the contact layer.

A seventh aspect of the present invention provides an electrical device which comprises (1) a resistive element composed of a first conductive material, which has a resistivity at 23° C. of 1 to 500,000 ohm.cm and comprising spaced apart substantially flat surfaces, which flat surfaces are in the same plane;

(2) interdigitated contact layers, composed of a second conductive material having a resistivity at 23° C. which is less than the resistivity of the first material, the contact layers being directly bonded to respective ones of the substantially flat surfaces; and (3) interdigitated further members composed of a third conductive material having a resistivity at 23° C. greater than $1\times10^{-5}$ ohm.cm but less than the resistivity at 23° C. of the second material, the further members being bonded to respective ones of the contact layers to provide a plurality of interdigitated electrodes, which are positioned and shaped such that when they are connected to a source of electrical power, they cause current to flow between them, through and in the plane of the resistive element.

Care is required to ensure satisfactory electrical contact, with a minimum of contact resistance, between two members of different resistivities. This is especially true when a large and/or long contact area is needed, as for example in strip heaters and large sheet heaters, where contact is to be made, for example, between a metallic member and a resistive element composed of a conductive polymer. Methods have been proposed for achieving such contact between a metallic member and a resistive element. Some of those methods involve heating the metallic member and the conductive polymer in contact therewith at a temperature above the melting point of the conductive polymer; the molten conductive polymer can be contacted with a suitable preheated metallic member, and/or the metallic member and conductive polymer can be heated after they have been brought into contact. It is also known to coat the metallic member with a highly conductive polymer, e.g., containing a relatively high concentration of silver or graphite, before contacting it with the conductive polymer of the resistive element. Other proposed methods involve the use of conductive adhesives, staples or rivets (or other low resistance connection member).

We have now discovered according to the fifth, sixth and seventh aspect of the invention that if a thin contact layer, composed of a material whose resistivity is between that of two conductive members having different resistivities is sandwiched between the two conductive members and is bonded to the surface of the highest resistivity member, improved electrical contact between the said two members is achieved.

The invention further provides a method of heating a substrate which comprises placing a heater according to the first, second, third or fourth aspect of the invention, or a device according to the fifth, sixth or seventh aspect of the invention, in thermal contact with the substrate, and passing electrical current through the heater so that it heats the substrate.

The invention is illustrated in the accompanying drawings, in which

FIG. 1 is a plan view of a heater according to the first aspect of the invention, FIG. 2 is a cross-section taken on line 2—2 of FIG. 1, FIG. 3 is a plan view of another heater according to the first aspect of the invention, FIG. 4 is a cross-section through a heater similar to that in shown in FIG. 3 but having additional insulating and thermally conductive members, FIG. 5 is a plan view of another heater according to the first aspect of the invention, FIG. 6 is a cross-section through a heater according to the second, third and fifth aspect of the invention, FIG. 7 is a plan view of the heater of FIG. 6, FIG. 8 is a cross-section through a heater according to the fourth aspect of the invention, FIG. 9 is a plan view of the heater of FIG. 8.

DETAILED DESCRIPTION OF THE INVENTION

Figure 1:
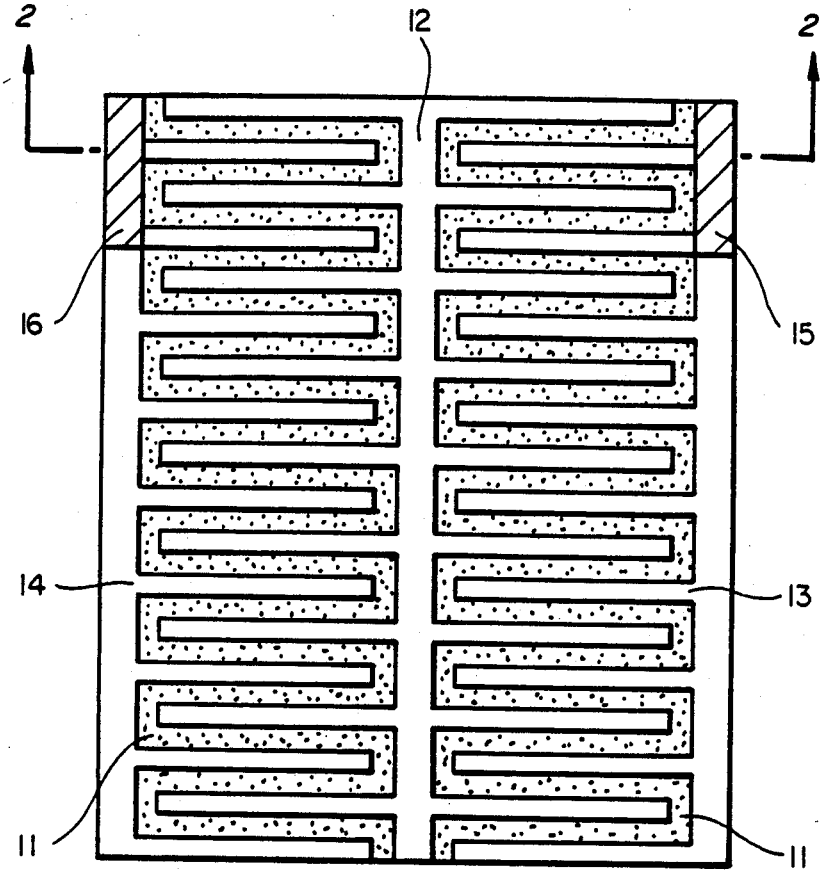

Preferred features of heaters according to the first, second, third and fourth aspect of the invention are now discussed in turn.

Heaters According to the First Aspect of the Invention

The heaters are preferably self-regulating heaters in which the laminar element comprises an element composed of a PTC conductive polymer. The invention, in its first aspect, will, therefore, be described chiefly by reference to such heaters. However, the invention, in its first aspect, also includes heaters in which the conductive polymer element does not exhibit PTC behavior.

It is to be understood that the heater can be part of a larger heater which does not meet the definition given above. Thus the invention, in its first aspect, includes for example a heater which comprises (1) a laminar element as defined above and (2) electrodes which in one or more areas are as defined above and in one or more areas fail to meet the definition given above, e.g. because the electrodes are too far apart.

The laminar element is composed of a conductive polymer composition, and preferably at least part of the element is composed of a conductive polymer composition which exhibits PTC behavior. Many such compositions are described in the various patents, patent applications and publications referred to above and incorporated by reference herein. Preferred compositions for use in this invention comprise carbon black, or a mixture of carbon black and graphite, as the conductive filler. The composition can also contain a non-conductive filler, which may be reinforcing or non-reinforcing, and/or a filler exhibiting non-linear properties. One or more of the fillers can be selected to have a high thermal conductivity, thus further reducing the tendency for hotlines to form.

The polymer preferably comprises at least one thermoplastic crystalline polymer. Particularly useful polymers are olefin polymers, including homopolymers, particularly polyethylene and the polyalkenamers obtained by polymerizing cycloolefins; copolymers of two or more olefins; and copolymers of one or more olefins, e.g. ethylene or propylene, with one or more olefinically unsaturated comonomers, preferably polar comonomers, e.g. vinyl acetate, acrylic acid methyl acrylate and ethyl acrylate. Also particularly useful are fluoropolymers (which may be olefin polymers), in particular polyvinylidene fluoride and copolymers of ethylene with tetrafluoroethylene and/or a perfluoro-alkoxy comonomer. Mixtures of polymers can be used, including mixtures of thermoplastic and amorphous, e.g. elastomeric, polymers. The conductive polymer can be cross-linked, preferably by irradiation, after it has been shaped, or while it is being shaped, into the laminar element. When metal electrodes are applied to a surface of the laminar element, such cross-linking is preferably carried out before the electrodes are applied, since improved adhesion can thereby be obtained. When electrodes containing a polymeric binder are employed, improved results may be obtained by cross-linking after the electrodes have been applied.

The preferred resistivity of the conductive polymer at room temperature (23° C.) will depend upon the dimensions of the laminar element and the power source to be used with the heater, but will generally be in the range from 1 to 500,000 ohm.cm, preferably 5–50 ohm.cm for very low voltages (up to 6 volts), 50–1,000 ohm.cm for low voltages (4 to 60 volts DC), 1,000 to 10,000 ohm.cm for normal supply voltages of about 110 to 240 volts AC, and 10,000 to 100,000 ohm.cm for voltages of greater than 240 volts AC.

The polymer is preferably melt-shaped, with melt-extrusion usually being preferred. When the melt-shaping method results in a preferred orientation of the conductive particles (as does melt-extrusion), the electrodes are preferably arranged so that current flow between them predominantly follows (e.g. is at an angle of not more than 30°, preferably not more than 15°, to) the direction of orientation (which, in the case of melt-extrusion, is the direction of extrusion). The laminar element can be very thin, but generally has a thickness of at least 0.002 inch, preferably at least 0.008 inch, particularly at least 0.01 inch. There is no upper limit on the thickness of the laminar element, but for reasons of economy (and in some cases flexibility) the thickness of the element is generally not more than 0.25 inch, and when the electrodes are applied to a surface of the element, is usually not more 0.1 inch, preferably not more than 0.05 inch, particularly not more than 0.025 inch.

An important feature of the present invention, in its first aspect, is the size and spacing of the electrodes, which appear to function both as current carriers and as heat sinks so as to minimize the voltage gradients within the PTC layer, resulting in high heat output and excellent stability. The electrodes are preferably ribbon-shaped elements secured on the same side of the laminar element, as is preferred, or on opposite sides of the element. It is also possible for ribbon-shaped electrodes to be placed on both surfaces of the conductive polymer element, usually as mirror images to ensure the desired direction of current flow. It is also possible for the electrodes to be within the thickness of the conductive polymer element, e.g. by sandwiching the electrodes between two conductive polymer elements, which can be the same or different.

The electrodes can be secured in or on the laminar element in any convenient way. We have obtained excellent results by printing a conductive ink onto the laminar element to form the electrodes, but the electrodes can also be applied through the use of polymer thick film technology, or by sputtering, or by a process comprising an etching step. The electrodes can also be formed on a surface of an insulating laminar element, for example by the techniques noted above or by etching, and the conductive polymer can then be secured to the electrodes and the insulating laminar element, for example by laminating a pre-formed film of the conductive polymer to the insulating element. The electrodes can for example be formed on the reverse side of a printed circuit board. Suitable materials for the electrodes include metals and metal alloys, for example silver, copper, ruthenium, gold and nickel. Electrodes comprising graphite can also be used.

The ratio of the average width of the electrodes, measured parallel to the faces of the laminar element, to the average distance between adjacent electrodes between which current passes, measured parallel to the faces of the laminar element, is at least 0.1:1, preferably at least 0.25:1, particularly at least 0.4:1, especially at least 0.5:1, with the higher ratios being preferred because they lessen the danger of hot-line formation. On the other hand, if this ratio is too high, only a small proportion of the laminar element is generating heat and part of the electrode is serving little, if any, useful purpose. Accordingly this ratio is preferably less than 10:1, particularly less than 5:1, especially less than 3:1. The electrodes are preferably equally spaced from each other, so that the heater generates heat substantially uniformly. However, variation of the distance between the electrodes is possible and can be desirable if non-uniform heating is desired. Preferably the electrodes are so positioned and dimensioned that, at all points, the distance between adjacent electrodes between which current passes, measured parallel to the faces of the laminar element, is not more than ten times, preferably not more than six times, especially not more than three times the average distance between adjacent electrodes between which current passes, measured parallel to the faces of the laminar element. The total surface area of the electrodes, viewed at right angles to the laminar element, to the surface area of one of the faces of the laminar element is preferably at least 0.1:1, particularly at least 0.25:1, especially at least 0.5:1.

Preferred patterns for the electrodes include interdigitating comb-like patterns of opposite polarities; a central backbone of one polarity with two comb-like patterns which interdigitate with opposite sides of the backbone and which both have a polarity opposite to the central backbone; and a central backbone with two comb-like patterns which interdigitate with opposite sides of the backbone and which are of opposite polarity to each other, with the backbone being at an intermediate voltage when a DC power supply is used or providing a neutral (which may be a floating neutral) when an AC power supply is used.

The electrodes can be quite thin (and may be thin enough for resistive heat generated by them to be significant) and when this is so, the heater will usually comprise bus connectors for the electrodes. These connectors will generally be straight strips of metal which run up one margin, or up a center line, of the heater. The connectors can be added after the electrodes have been applied, or they can be secured to the laminar element and the electrodes applied over both.

The heaters generally comprise laminar insulating elements covering the conductive element and electrodes, in order to provide both physical and electrical protection. In a number of the uses for the heaters, an important advantage is that the heaters can be flexible, and for such uses, preferred insulating elements are flexible polymeric films. The heater can also comprise a coating of an adhesive, which may be for example a pressure-sensitive adhesive optionally covered by a release sheet, or an adhesive which can be activated by heat, e.g. from the heater itself.

The heaters can also comprise, on part or all of one or both surfaces thereof, and optionally extending therefrom, a thermally conductive member, e.g. a metal foil or a layer of a polymer having thermally conductive particles, e.g. graphite or carbon fibers, disposed therein. If the thermally conductive element is also electrically conductive, it will normally be electrically insulated from the electrodes and the conductive polymer element.

The novel heaters have a wide variety of uses, including in particular the heating of handlebars on motorcycles and bicycles, the heating of electrical devices, for example batteries, e.g. in vehicles, the heating of pipes and tanks, the heating of antennas, and the heating of electronic components, including printed circuit boards. If desired, the conductive polymer laminar element can be heat-recoverable, preferably heat-shrinkable, so that when the device is powered, the laminar element recovers, e.g. into conforming contact with an adjacent substrate. The electrodes should be arranged so that they do not need to change shape when recovery takes place, or should be such that they can change shape when recovery takes place, for example by reason of apertures, slits, corrugations or other lines of physical weakness in those parts of the electrodes which need to change shape on recovery. Alternatively, the heater is not in itself heat-recoverable, but is secured to a heat-recoverable substrate, e.g. a heat-shrinkable cross-linked polymeric film or other shaped article, having a recovery temperature below the temperature at which the heater controls, so that when the heater is powered, it causes recovery of the substrate, preferably without substantially retarding such recovery. A heater for use in this way can for example comprise a plurality of apertures or slits through the ribbon-shaped electrodes, thus permitting the shape of the heater to be changed, especially when it is hot.

Heaters According to the Second Aspect of the Invention

Insulation of the heater is preferably completed by means of a second laminar insulating element which is secured to the second face of the resistive element (preferably by means of a substantially continuous layer of adhesive) and to the edge portions of the first insulating element, e.g. by means of an adhesive or a melt bond. The insulating elements are preferably flexible polymeric sheets having a melting point substantially above the operating temperature of the heater. When using a heater comprising such insulating elements, the second element is preferably placed adjacent the substrate to be heated, since the adhesive layer assists heat transfer, whereas the separation of the first element from the heating element results in a relative thermal barrier.

The heaters are preferably flexible, by which is meant that at 23° C., and preferably at −20° C., they can be wrapped around a 4 inch diameter mandrel, preferably around a 1 inch diameter mandrel, without damage.

The laminar resistive element can be a layer of any resistive material, either PTC or ZTC, but is preferably composed of a conductive polymer. The conductive polymer is preferably melt-shaped, particularly melt-extruded, in which case the resistive element will usually be at least 0.002 inch thick, preferably 0.01 to 0.25 inch thick, particularly 0.01 to 0.1 inch thick. However, the conductive polymer can also be shaped as a composition containing a solvent or liquid dispersing medium which is subsequently evaporated.

The invention in its second aspect is particularly useful when the electrodes are placed on the resistive element by a process which results in a bond which is vulnerable to damage by flexing or thermal cycling. The electrodes can for example be formed by printing, particularly silk screen printing, a conductive ink onto the resistive element, or by the use of polymer thick film technology, or by sputtering, or by a process comprising an etching step.

The electrodes are preferably arranged in the manner of the heater according to the first aspect of the invention.

Preferably the electrodes are so positioned and dimensioned that, at all points, the distance between adjacent electrodes between which current passes, measured parallel to the faces of the resistive element, is not more than three times the average distance between adjacent electrodes between which current passes, measured parallel to the faces of the resistive element. It is particularly preferred that the ratio of the average width of the electrodes to the average distance between the electrodes between which current passes is from 0.4:1 to 5:1, especially an arrangement in which the electrodes comprise a plurality of parallel bars which are preferably spaced apart from each other by substantially the same distance. When the conductive polymer has been melt-extruded, the electrodes are preferably arranged so that the current flows along the direction of extrusion.

When the heater requires a ground plane, e.g. if it is to be used in hazardous location, it preferably includes a laminar metallic element which functions as a ground plane, and which is preferably positioned adjacent the face of the first laminar insulating element remote from the resistive element, and/or adjacent the face of the second insulating element remote from the element. The ground plane can be of a known kind, but is preferably arranged so as to permit relative movement between the ground plane and the adjacent insulating jacket, that is as in the heater according to the third aspect of the invention.

When the heater comprises a plurality of electrodes which are positioned on a surface of the resistive element and connected by bus bars, the bus bars are preferably in the form of laminar members. The bus bars can be, but preferably are not, secured to the first insulating element, and when the bus bars are folded around the edge of the heating element, as disclosed in said application, they can be, but preferably are not, secured to the second insulating element.

Heaters According to the Third Aspect of the Invention

The heaters are preferably flexible, by which is meant that at 23° C., and preferably at −20° C., they can be wrapped around a 4 inch diameter mandrel, preferably around a 1 inch diameter mandrel, without damage.

The laminar metallic member can be apertured, e.g. an expanded metal mesh, but is preferably a foil, especially a substantially continuous metallic foil, particularly a copper foil. The thickness of the foil is generally 0.0002 inch to 0.010 inch, preferably 0.001 to 0.005 inch. The member must function as a ground plane for the heater, and is therefore preferably coextensive with the heater or extends beyond it.

The metallic member is preferably maintained adjacent the insulating jacket by an auxiliary insulating member which is secured to the insulating jacket, and which is preferably composed of a flexible polymeric material. Preferably the insulating jacket and the auxiliary insulating member are each composed of an organic polymeric composition.

The heater can include a single metallic member, or it can include two metallic members, one on each side of the heating element. When there are two members, they can be electrically connected to each other. The current-carrying capacity of each metallic member (or of both together when they are connected to each other) is preferably at least equal to the current-carrying capacity of the heating element.

The insulating jacket is preferably composed of flexible polymeric material. When the heating element comprises electrodes positioned on a face of a resistive element, the insulating jacket preferably comprises (a) a first laminar insulating element which is adjacent to the electrodes and to the first face of the resistive element but is not secured to the electrodes or to the resistive element, and (b) a second laminar insulating element which is secured to the opposite face of the resistive element and to the first insulating element. The use of such a heating element and insulating jacket is as in the invention corresponding to the second aspect of the invention. Preferably the second insulating element is secured to the resistive element by a substantially continuous layer of adhesive and to the first insulating element by adhesive or melt-bonding.

The laminar heating element can be of any kind, but preferably comprises a layer of resistive material having electrodes on one or both surfaces thereof or embedded therein. The resistive material is preferably a conductive polymer. The conductive polymer is preferably melt-shaped, particularly melt-extruded, in which case the heating element will usually be at least 0.002 inch thick, preferably 0.01 to 0.25 inch thick, particularly 0.01 to 0.1 inch thick. Where the conductive polymer has been melt-extruded, the electrodes are preferably positioned so that current passing between the electrodes follows a path which is substantially parallel to the direction of extrusion. However, the conductive polymer can also be shaped as a composition containing a solvent or liquid dispersing medium which is subsequently evaporated. The conductive polymer preferably exhibits PTC behavior. Other laminar heating elements can be used, either PTC or ZTC, including inorganic materials in the form of layers and resistive wires arranged in laminar configurations.

When the heating element comprises a plurality of electrodes positioned on a face of a laminar resistive element, the electrodes are preferably arranged in the manner of the first aspect of the present invention.

Preferably the electrodes are so positioned and dimensioned that, at all points, the distance between adjacent electrodes between which current passes, measured parallel to the faces of the resistive element, is not more than ten times, preferably not more than six times, especially not more than three times the average distance between adjacent electrodes between which current passes, measured parallel to the faces of the resistive element. It is particularly preferred that the ratio of the average width of the electrodes to the average distance between the electrodes between which current passes is from 0.4:1 to 5:1, especially an arrangement in which the electrodes comprise a plurality of parallel bars which are preferably spaced apart from each other by substantially the same distance. When the conductive polymer has been melt-extruded, the electrodes are preferably arranged so that the current flows along the direction of extrusion.

When the heater comprises a plurality of electrodes which are positioned on a surface of the resistive element and are connected by bus bars, each of the bus bars is preferably a longitudinally folded tape which envelopes one edge of the heating element.

Heaters According to the Fourth Aspect of the Invention

The dielectric layer is positioned over at least part of the electrodes, the dielectric layer having been applied directly onto the electrodes in liquid form, and then solidified so that the solidified layer is intimately bonded to at least part, preferably the said at least part, of the electrodes.

In this context the word "directly" is used to mean that there is no intermediate composition, for example adhesive composition, between the electrodes and the dielectric layer.

Preferably no other member is bonded to the second surface of the dielectric layer, either during the solidification process or after solidification has taken place. However, if such a member is present either the bond between it and the dielectric layer has a peel strength less than that of the bond between the dielectric layer and the electrodes or the bond to it has a peel strength less than 3 lbs./linear inch at 20° C.

The dielectric layer is applied in liquid form. Preferably the dielectric layer is applied in liquid form at a temperature below 120° F.

The dielectric layer can extend over the whole or only part of the electrodes. Where the electrodes are to be powered by positioning an electrical connection member on top of the electrodes, the dielectric layer preferably extends over and contacts only part of the electrodes so that the uncovered parts are accessible and can contact the connection means. The dielectric layer is preferably also positioned over at least part of the resistive element and intimately bonded thereto.

The dielectric layer is applied in liquid form and then solidified into intimate contact with at least part of the electrodes. An external stimulus may be applied to effect the solidification process, or the solidification may occur at ambient temperature in the absence of any such stimulus. Suitable compositions for the dielectric layer include compositions wherein the liquid form of the dielectric layer comprises a curable material, curing of which effects the solidification of the dielectric layer. As examples of curable materials that may be used, there may be mentioned two-part systems which when mixed will cure over a given period of time, in some cases with the application of an external stimulus for example, heat, e.g., two-part silicone systems wherein one part comprises a silicone monomer, and the other part comprises a catalyst, for example Sylgard (tradename) 577 silicone (as supplied by Dow Corning) and two-part epoxy systems. Further examples of curable materials include single or two-part systems that cure in the presence of moisture, heat, or a combination of moisture and heat. Dielectric layers according to the present invention, and particularly those dielectrics that comprise curable compositions that cure with the application of no or little heat, or other external stimulus, are advantageous, since application of such a dielectric layer has little or no affect on the resistive material, the electrodes or the interface therebetween. This is to be contrasted with application of a dielectric layer by methods such as melt bonding, or adhesive bonding, which depending on the composition of the resistive layer and/or the temperature of melt bonding may have a deleterious effect on the resistive material, electrodes or interface therebetween.

The dielectric layer preferably has a tensile strength sufficiently low that it can change its dimensions in accord with those of the electrode and/or resistive element during heating and expansion of the device and/or during physical deformations of the device. This ensures that any relative movement between the dielectric layer and the electrodes and/or resistive element, which might detrimentally effect the electrodes or the electrode/resistive element interface is avoided or at least minimized. Preferably the dielectric layer has a tensile strength of less than 4,000 psi, more preferably less than 3,000 psi, especially preferably less then 2,000 psi.

The heaters are preferably flexible, by which is meant that at 23° C., and preferably at −20° C., they can be wrapped around a 4 inch diameter mandrel without damage.

The resistive element preferably exhibits PTC behavior. PTC materials increase in resistivity with an increase in temperature, and typically exhibit a sharp change in the resistivity at a certain temperature $T_s$, known as the switching temperature. Where the resistive element exhibits PTC behavior, the solidified dielectric layer preferably has a dielectric strength of at least 1 Volt per 0.001 inch at $T_s$, the switching temperature.

The resistive element is preferably at least 0.002 inches thick.

The resistive element may comprise any suitable conductive polymer material. In a preferred embodiment, the dielectric layer is bonded to the resistive layer as well as to the electrodes. In this preferred case the invention is particularly useful where the resistive element comprises a material having a low surface energy, for example, less than 40, especially less than 35 dynes/cm, and more especially less than 30 dynes/cm, e.g. 28 dynes/cm since such material can not easily be bonded to other material, such as the dielectric layer, by conventional bonding techniques such as melt bonding or adhesive bonding.

The resistive element preferably has a resistivity at 23° C. of at least 0.5 ohm.cm, preferably in the range 0.4 to 100,000 ohm.cm, especially in the range 0.5 to 100,000 ohm.cm.

The resistive element is preferably cross-linked. Cross-linking is preferably effected by radiation, for example by electrons or by gamma irradiation. It may also be effected by chemical cross-linking. Where the resistive element is cross-linked by irradiation it is preferably subjected to a beam dose of at least 5 Mrads, preferably at least 12 Mrads, for example 14 Mrads. Preferably half the beam dose is directed onto one major surface of the resistive element and the remainder is directed onto the other major surface of the resistive element. Preferably the element is cross-linked to the same beam dose throughout.

The electrodes can, for example, be formed by printing, particularly silk screen printing a conductive ink onto the resistive element, or by the use of polymer thick film technology, or by sputtering, or by a process comprising an etching step. The invention is particularly useful in such cases because application of the dielectric has little or no effect on the resistive element-/electrode interface.

The electrodes preferably comprise a conductive polymer, for example in the form of an ink, in which the conductive filler consists of or contains a metal, preferably silver, or a mixture of silver and graphite. The electrodes preferably have a resistivity in the range $2.5\times10^{-4}$ to $1\times10^{-3}$ ohm.cm.

In a preferred embodiment the heater also comprises a contact layer between the electrodes and the resistive element, the contact layer having a resistivity intermediate to that of the electrodes and the resistive element. The contact layer preferably also comprises a conductive polymer, which preferably contains no metallic filler only graphite and/or carbon black as the conductive filler. The contact layer is preferably also provided as a conductive ink which is printed on the resistive element before the electrode layer. Such a heater is described in particular with reference to the sixth and seventh aspect of the present invention.

Preferably the heater according to the invention comprises a laminar polymeric insulating element which is adjacent to, but not secured to, the electrodes or the dielectric layer or the electrode-bearing face of the resistive element. Preferably the insulating element is arranged in the manner according to the second aspect of the invention.

The electrodes are preferably arranged in the manner according to the first aspect of the invention.

Preferably the electrodes are so positioned and dimensioned that, at all points, the distance between adjacent electrodes between which current passes, measured parallel to the faces of the resistive element, is not more than three times the average distance between adjacent electrodes between which current passes, measured parallel to the faces of the resistive element. It is particularly preferred that the ratio of the average width of the electrodes to the average distance between the electrodes between which current passes is from 0.4:1 to 5:1, especially an arrangement in which the electrodes comprise a plurality of parallel bars which are preferably spaced apart from each other by substantially the same distance. Preferably adjacent electrodes are less than 1 inch apart. When the conductive polymer has been melt-extruded, the electrodes are preferably arranged so that the current flows along the direction of extrusion.

When the heater requires a ground plane, e.g. if it is to be used in a hazardous location, it preferably includes a laminar metallic element which functions as a ground plane, as in the third aspect of the invention.

When the heater comprises a plurality of electrodes which are positioned on a surface of the resistive element and connected by bus bars, the bus bars are preferably in the form of laminar members.

Heaters according to the fourth aspect of the present invention were found to have improved physical and electrical properties compared to identical heaters without the dielectric layer. For example, the presence of the dielectric layer significantly increases the force required to damage an electrode, compared to an uncovered electrode. Also, even if the electrode is damaged, e.g., if there is a break in one of the electrodes as might occur for example if a sheet heater is incorrectly installed in a buckled position and then impacted, no continued sparking or subsequent burning of the underlying resistive element occurs even though the break in the electrodes results in arcing across the break, which in prior art heaters would frequently result in sparking and subsequent burning. Without limiting the invention in any way, it is thought that the absence of sparking and burning in the heater of the instant invention may be due to the fact that the dielectric layer prevents, or at least minimizes, access of oxygen to the break in the electrode so that any sparking and burning can not be sustained, and also that the material of the dielectric may be selected as one which has a high resistance to tracking, for example a silicone, and therefore extinguishes any continued sparking. Thus the dielectric layer makes the heater electrically safe.

Also the dielectric layer prevents water or any other electrolyte contacting and bridging the electrodes, and therefore avoids the possibility of short circuits between the electrodes and the problems of consequent sparking and burning of the resistive element. In this respect the invention is particularly useful when adjacent electrodes are less than 1 inch apart, and easily short-circuited.

Preferred features of devices according to the fifth, sixth and seventh aspect of the invention are now described.

Devices According to the Fifth, Sixth and Seventh Aspect of the Invention

There is preferably no direct physical contact between the resistive element and the further member.

The resistive element in the devices is preferably composed of a conductive polymer. When the device is a heater, the conductive polymer preferably exhibits PTC behavior, thus rendering the heater self-regulating. The preferred range of resistivity at 23° C. depends upon the dimensions of the heater and the power supply to be used, e.g. 5 to 50 ohm.cm for voltages up to 6 volts DC, 50 to 500 ohm.cm for 4 to 60 volts DC, 500 to 10,000 ohm.cm for 100 to 240 volts AC and 10,000 to 100,000 ohm.cm for voltages greater than 240 volts AC. The conductive filler in the conductive polymer usually comprises, and preferably consists essentially of, carbon black.

The contact layer preferably also is composed of a conductive polymer. The contact layer can exhibit PTC, substantially ZTC or NTC behavior in the operating temperature range of the device. The ratio of the resistivity of the resistive layer material to the resistivity of the contact layer material is preferably at least 20:1, preferably at least 100:1, especially at least 1000:1, or even higher, e.g. at least 100,000:1. The contact layer can be applied to the resistive layer by printing a conductive ink thereon, or through use of polymer thick film technology, or by a process comprising an etching step, or in any other way. The contact layer can be present only between the most conductive member and the resistive element, or can extend beyond the connection member, in which case it may act as a preferential current carrier.

In the device according to the fifth aspect of the present invention, wherein the lowest resistivity member is preferably metal and preferably functions as a connection means, it is preferred that the contact layer extends beyond the lowest resistivity member in which case it can provide one or more electrodes which extend beyond the connection member.

In the device according to the sixth aspect of the present invention, wherein the further member has a resistivity greater than $1\times10^{-5}$ ohm.cm, and is therefore non-metallic, it is preferred that the contact layer has the same configuration as, and extends slightly beyond, the further member, so that there is no direct contact between the further member and the resistive element. In this case the further member, may itself provide one or more electrodes. The devices of the fifth, sixth and seventh aspect of the invention each provide three components arranged relative to each other so that an electrical path can exist from the component having the lowest resistivity of the three components to the component having the highest resistivity of the three components through the other, intermediate resistivity component. The devices may comprise more than three components of different resistivity. Where there are more than three components, the components are preferably arranged sequentially in order of their resistivity, so that the electrical contact between any two components is improved by the presence of an intermediate resistivity layer between them. For example, a preferred electrical device comprises four components of different resistivities in which the component having the lowest resistivity of the four comprises a metal connection member for connection to an electrical power source. It contacts a second higher resistivity member, which preferably extends beyond the connection member to provide electrodes, and in turn contacts a third higher resistivity layer, which preferably has the same configurations, but extends slightly beyond the second layer. The third layer in turn contacts a higher resistivity layer which preferably provides a substrate resistive element. The device according to the seventh aspect of the invention comprises four members of sequentially increasing resistivity.

By arranging one or more intermediate resistivity layers between the members of different resistivities in this way, good electrical contact may be achieved between members having resistivities differing by $10^{10}$ ohm.cm, and even up to $10^{12}$ ohm.cm.

In preferred devices according to the fifth, sixth and seventh aspect of the invention, particularly in preferred devices according to the fifth aspect of the present invention, the contact layer preferably comprises a conductive polymer in which the conductive filler consists of or contains a metal, preferably a silver, or a mixture of silver with graphite or silver with graphite and carbon black. In this case the contact layer preferably has a resistivity in the range $2.5\times10^{-5}$ to $\times10^{-3}$ ohm.cm. In other preferred devices according to the invention, particularly in devices according to the sixth aspect of the present invention, the contact layer preferably comprises a conductive polymer in which the conductive filler consists of graphite and/or carbon black, or a mixture of graphite and/or carbon black with a metal, for example silver, wherein there is more graphite and/or carbon black than silver. In this case the contact layer preferably has a resistivity in the range $0.5\times10^{-2}$ to 0.1 ohm.cm.

Preferred features of the further member in devices according to the fifth, sixth and seventh aspect of the invention are now discussed. Particularly in devices according to the fifth aspect of the present invention, wherein the further member preferably provides a connection member, that member is preferably composed of at least one metal, e.g. copper, which is usually preferred for reasons of economy, aluminum, nickel, silver or gold, or a coating of one metal on another, e.g. nickel-coated or tin-coated copper, and is usually a wire or sheet or tape, and may be straight or bent or folded. Generally there are two or more connection members in each device, the members being connectable to a power supply to cause current to pass through the resistive element. Often the connection area between each connection member and a contact layer is at least 0.5 square inch preferably at least 5 square inch, e.g. at least 10 square inch in area and can be very much more. The connection area often has at least one dimension greater than 0.5 square inch, preferably greater than 1 inch and can be much more, e.g. at least 5 inch. Preferably the connection member makes substantially continuous contact with the contact layer, but this is not essential.

In the devices according to the fifth, sixth and seventh aspect of the invention and particularly in devices according to the sixth aspect of the present invention wherein the further member has a resistivity greater than $\times10^{-5}$, and is therefore non-metallic, that member is preferably composed of a conductive polymer. The member can exhibit PTC, substantially ZTC or NTC behavior in the operating temperature range of the device. In certain embodiments of devices according to the sixth aspect of the invention the ratio of the resistivity of the contact layer to the resistivity of the further member may be from as little as 5:1 to as much as 10,000:1, preferably it is in the range 10:1 to 1,000:1, for example 100:1.

The further member has a resistivity less than that of the contact layer but greater than $1\times10^{-5}$ ohm.cm.

Preferably the further member has a resistivity in the range $1\times10^{-5}$ to $1\times10^{-2}$ ohm.cm, more preferably in the range $1\times10^{-4}$ to $1\times10^{-3}$ ohm.cm. In a preferred embodiment the resistivity is about $5\times10^{-4}$ ohm.cm.

Where the further member comprises a conductive polymer, it may be applied to the contact layer in the same way that the contact layer is applied to the resistive layer, that is by printing a conductive ink on the contact layer, through the use of polymer thick film technology, or by a process comprising an etching step or it may be applied in any other way.

Devices according to the fifth aspect of the invention include (i) sheet heaters, e.g. a sheet heater wherein the resistive element is a laminar element comprising a spaced-apart substantially flat surface to which the contact layers are bonded and in particular include sheet heaters wherein the further members are connection members, the connection members having substantially flat surfaces which are pressed against the respective contact layers, and the contact layers extend beyond the areas of contact with the connection members to provide a plurality of electrodes; and (ii) strip heaters wherein the resistive element is in the form of a strip comprising spaced-apart concave surfaces to which the contact layers are bonded, and the connection members have substantially complementary convex surfaces which are pressed against the respective contact layers.

Devices according to the sixth aspect of the present invention include sheet heaters, wherein the further member itself provides a plurality of electrodes and wherein the contact layer is at least coextensive with the electrodes and preferably extends slightly beyond the electrodes. Preferably the contact layer has the same configuration as the electrodes. The contact layer and the electrodes are preferably each in the form of conductive inks that are applied sequentially to the resistive layer by a printing process.

Devices according to the sixth aspect of the invention preferably also include a metal connection member, for connection to an electrical power source. The connection member is preferably in contact with the electrodes, and preferably has all the preferred features attributed to the further member of the devices according to the fifth aspect of the invention.

In devices according to the sixth aspect of the invention, the resistive element is preferably a laminar element comprising spaced-apart substantially flat surfaces to which respective contact layers are bonded, the further members providing a plurality of electrodes, which, when connected to a source of electrical power, cause current to flow through the resistive element, preferably in the plane of the resistive element. The contact layers preferably have the same general configuration as the electrodes, but extend beyond the electrodes. In the case of interdigitated electrodes the contact layers are preferably from 1.5 to 3 times as wide as the electrodes, for example about twice as wide. Devices according to the present invention preferably include a dielectric layer, covering and intimately bonded to at least part of the electrodes in the manner of heaters according to the fourth aspect of the invention.

In the device according to the fifth aspect of the present invention the connection area between the resistive element and the further member is at least 1, preferably at least 5 square inches in area. The connection area preferably has at least one dimension greater than 3 inches.

An advantage of devices according to the fifth, sixth and seventh aspect of the invention is that they can be used in applications where it is necessary for the device to carry a current of at least 5, and in some situations at least 10 Amps.

In devices according to the sixth aspect of the present invention, particularly in sheet heaters, wherein the further members preferably provide a plurality of electrodes, for example interdigitated electrodes, on a surface of laminar resistive element, and the respective contact layers provide an intermediate resistivity layer between the electrodes and the resistive element, the presence of the contact layers not only improves the electrical contact between the electrodes and resistive elements, but also significantly improves the voltage stability of the devices, as compared with devices in which there are no intermediate contact layers and the electrodes directly contact the resistive element. The voltage stability of a device indicates how the resistivity of the device changes with voltage. It is conventionally recorded in terms of a linearity ratio (LR), that is the ratio of the resistance at a low voltage (typically 30 mV) to the resistance at a high voltage (typically 100 V). Ideally, for a completely stable material the linearity ratio is 1. The improvement in the voltage stability in devices according to the sixth aspect of the invention, as compared to identical devices in which there is no intermediate resistivity layer between the electrodes and the resistive layer, is particularly substantial where the device has been subjected to in-rush currents or to temperature ageing.

A comparative test was carried out to show the improvement in voltage stability of a device according to the sixth aspect of the present invention (incorporating an intermediate resistivity layer between the electrodes and the resistive element), as compared to a comparative, control, device (with no intermediate resistivity layer), after submitting the devices to a cycling voltage treatment or an ageing treatment. In the test, comparative control devices (with no intermediate resistivity layer) were prepared by printing on a conductive polymer resistive element a single layer of interdigitated electrodes, comprising a vinyl based conductive ink containing silver, graphite and carbon black, and devices according to the invention (with an intermediate layer) were prepared by sequentially printing onto an identical resistive element interdigitated contact layers, and respective interdigitated electrodes over each contact layer, the contact layer comprising a vinyl based conductive ink containing graphite and carbon black only and having a resistivity intermediate to that of the electrodes and the resistive element. In the control devices, the interdigitated electrodes were 1/16 inch wide and separated by ¼ inch. In the devices according to the fifth, sixth and seventh aspect of the invention the electrodes were again 1/16 inch wide, the contact layers were ⅛ inch wide, and adjacent contact layers were separated by ¼ inch.

Three sets of test and control devices were prepared. The first set of devices were maintained as virgin samples. The second set of devices were subjected to a cycling voltage input in which a current at 240 Volts was pulsed on and off at 15 minute intervals. The pulsing was carried out at 70° F., for 250 cycles. The cycling represents the in-service treatment of the devices which are continually switched on and off and therefore subjected to so-called "in-rush" current each time they are switched on. A third set of devices were powered continuously at 240 V and aged for 1 week at 225° F. The resistivity of each set of devices was measured at 70° F. at 30 mV and 100 V continuous current, and the linearity ratio of each set calculated. The results are set out in the Table below.

TABLE

| | Linearity Ratio Control Samples (no intermediate layer) | Linearity Ratio Test Sample (including intermediate resistivity layer |
|---|---|---|
| Virgin samples | 1.005 | 1.005 |
| Cycled samples | 1.036 | 1.006 |
| Aged samples | 1.034 | 1.008 |

As can be seen the linearity ratio of the control devices is significantly and detrimentally increased by the cycling and ageing treatments, while the linearity ratio of the test devices is only slightly increased. Referring now to the drawings FIGS. 1 to 5 show a heater according to the first aspect of the invention.

Figure 2:
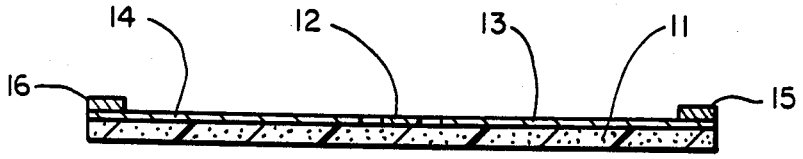

Referring first to FIGS. 1 and 2, a laminar PTC conductive polymer element 11 carries on one surface thereof an electrode 12 in the form of a central backbone and interdigitating comb-like electrodes 13 and 14. Secured on top of electrodes 13 and 14 are termination pads 15 and 16 of opposite polarity.

Figure 3:
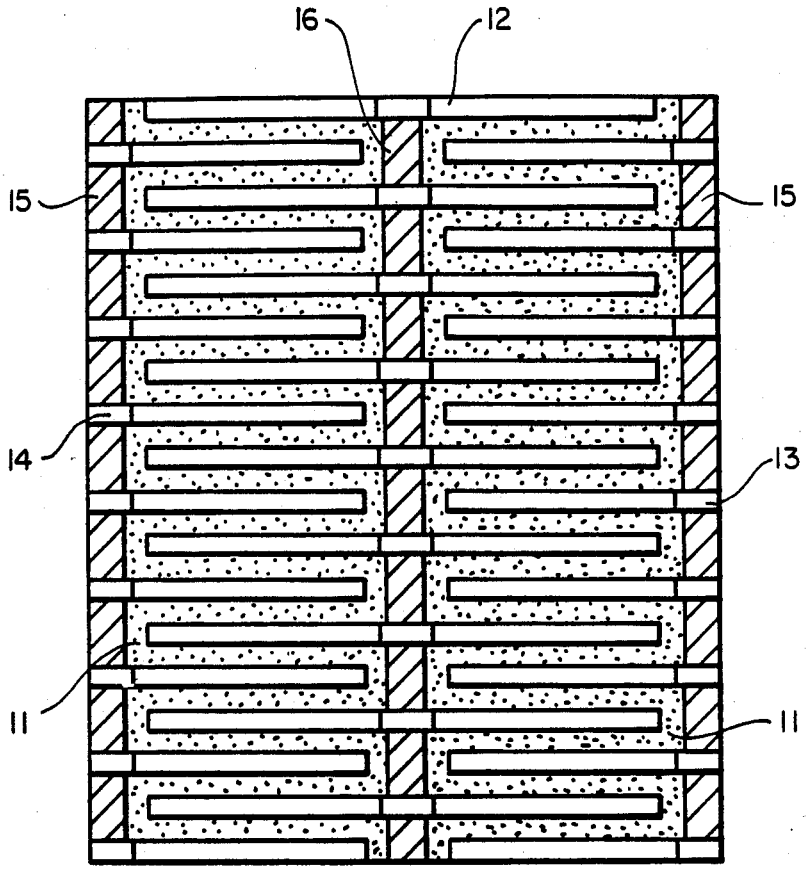

Referring now to FIG. 3, a laminar PTC conductive polymer element 11 carries on one surface thereof three parallel bus connector strips, the center connector 16 being of one polarity and the outer connectors 15 being of opposite polarity. Printed on top of the element 11 and the connectors 15 and 16 are electrodes 12, 13 and 14 (the electrodes could also be printed as a continuous pattern, as in FIG. 1, instead of a series of strips connected by the bus connectors, but the illustrated embodiment is more economical).

Figure 4:
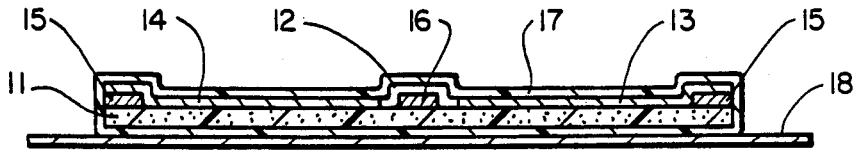

Referring now to FIG. 4, this is a cross-section through a heater which has the same electrical components as FIG. 3, but which also includes an insulating jacket 17 which surrounds the electrical components and a thermally conductive base member 18, e.g. of metal, which completely covers one surface of the heater and extends outwardly therefrom.

Figure 5:
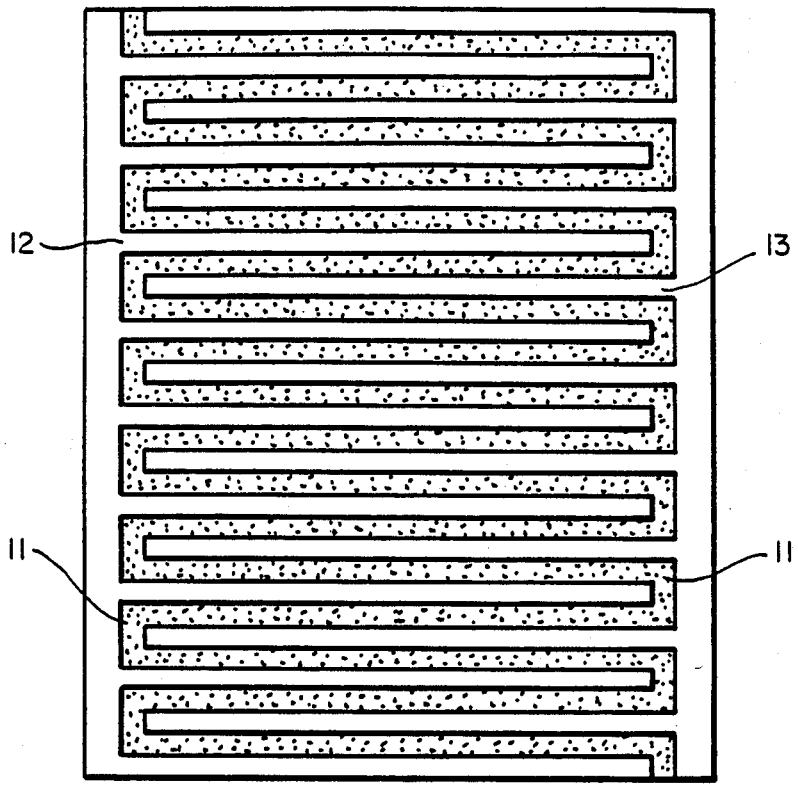
Figure 6:
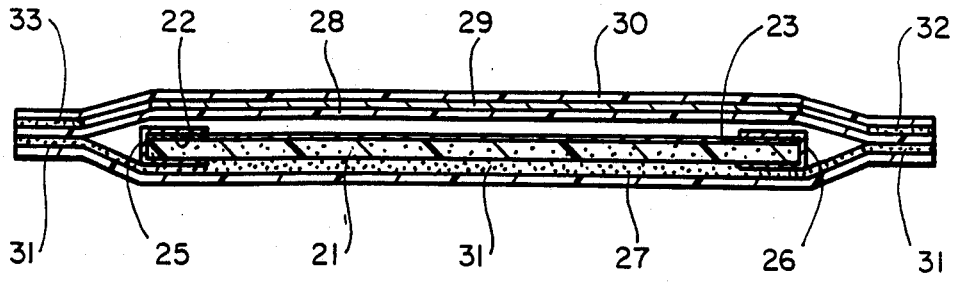
Figure 7:
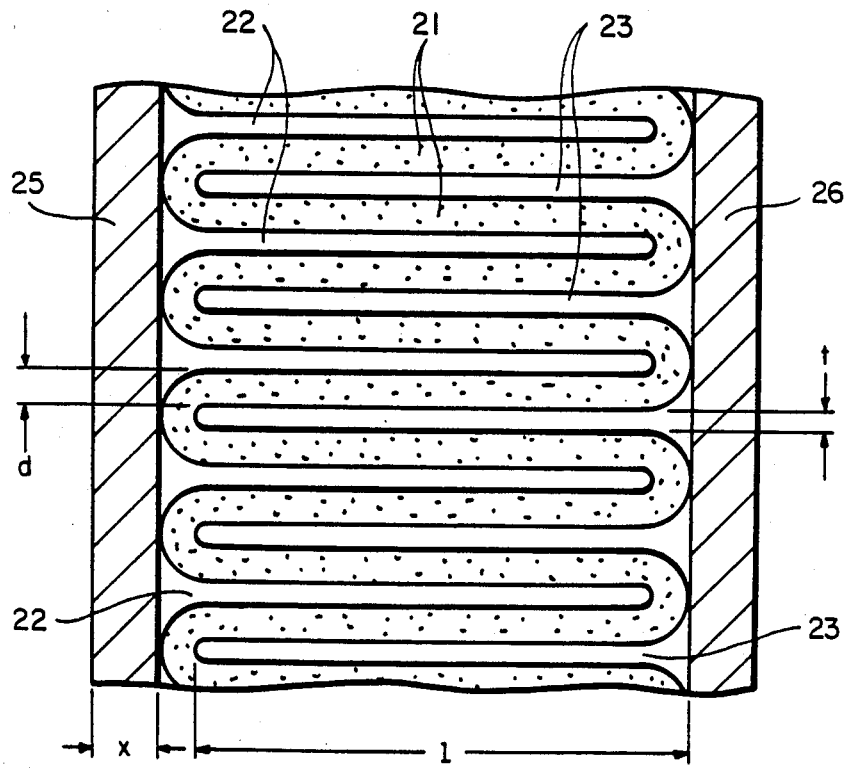

Referring now to FIG. 5, this shows a PTC conductive polymer element 11 having printed on one surface thereof interdigitating comb-like electrodes 12 and 13. Underneath the marginal portions of the electrodes are bus connector strips which are not shown in the Figure. FIGS. 6 and 7 illustrate a heater according to the second, third and fifth aspect of the invention. It comprises a heating element comprising a laminar conductive polymer resistive element 21 having printed on the top surface thereof interdigitated electrodes 22 and 23. The electrodes 22 and 23 are composed of a conductive polymer composition containing a metal, e.g. silver, as the conductive filler and having substantially lower resistivity than the conductive polymer in the element 21. Bus bars 25 and 26, composed of metal mesh, are folded around marginal portions of the element 21 and the electrodes 22 and 23 respectively. An insulating jacket (shown in FIG. 6 only) is formed around the heating element, and bus bars by a polymeric bottom sheet 27 and a polymeric top sheet 28. Sheet 27 is secured to the bottom of the heating element, to the bottom of the bus bars and to edge portions of the top sheet by a substantially continuous layer of adhesive 31. The top sheet is adjacent to, but not secured to, the bus bars, electrodes and resistive element. On top of the top sheet there is a metallic, e.g. copper, foil 29 which is maintained in position by an outer polymeric insulating sheet 30, whose marginal portions are secured to the marginal portions of the sheet 28 by adhesive layers 32 and 33. As shown in FIG. 7, the electrodes have a width t and a length l, and are separated by a distance d, and the bus bar have a width x. Typical values for these variables are

| | |
|---|---|
| t | 0.03–0.2 inch |
| l | 0.5–6.0 inch |
| d | 0.1–0.3 inch |
| x | 0.2–0.8 inch |

Figure 8:
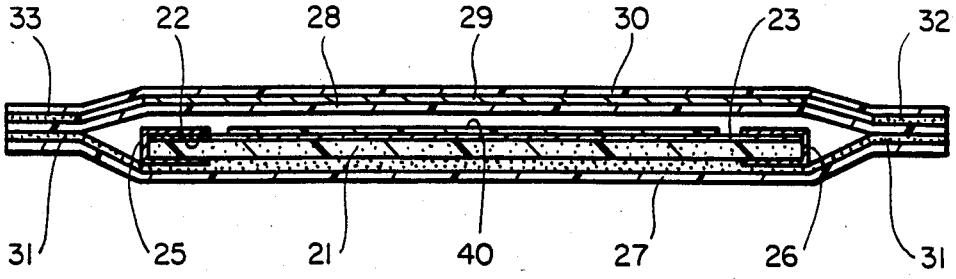
Figure 9:
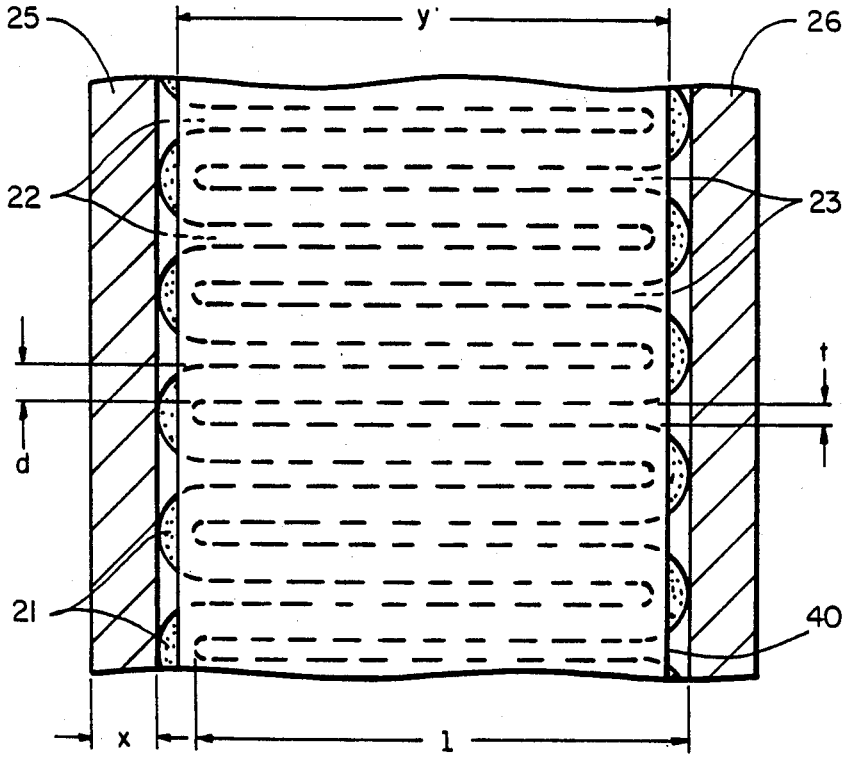

FIGS. 8 and 9 illustrate a heater according to the fourth aspect of the invention. The heater is identical to the heater illustrated in FIGS. 6 and 7 except that there is an additional layer; a dielectric layer 40. The dielectric layer 40 overlies the interdigitating portions of the electrodes 22 and 23, but does not extend to the longitudinal margins of the electrodes. The dielectric layer 40 comprises a two part curable silicone system which has been applied in liquid form over the element 21 and electrodes 22 and 23, and then heated to 275° F. for 10 minutes to cure the dielectric and thereby solidify it. The solidified dielectric layer 40 is intimately bonded to the underlying element 21 and electrodes 22 and 23. The top insulating sheet 28 is adjacent to, but not secured to the additional dielectric layer 40.

Figure 10:
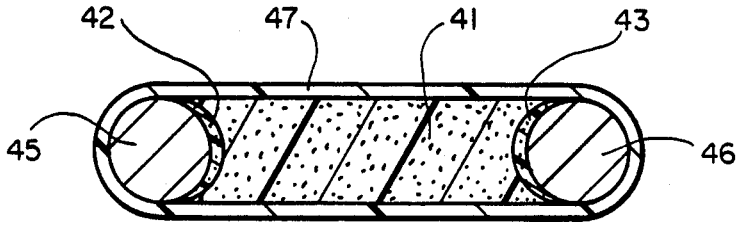
FIG. 10 is a cross-section through a strip heater according to the fifth aspect of the invention.

FIG. 10 is a cross-section through a self-regulating strip heater having a constant cross-section along its length. An elongate strip 41 of PTC conductive polymer has concave edges which are coated with contact layers 42 and 43 of a ZTC conductive polymer whose resistivity at room temperature is several times less than that of the PTC conductive polymer. Elongate wires 45 and 46, which may be solid or stranded, are pressed against the contact layers 42 and 43 respectively by means of polymeric insulating jacket 47.

Figure 11:
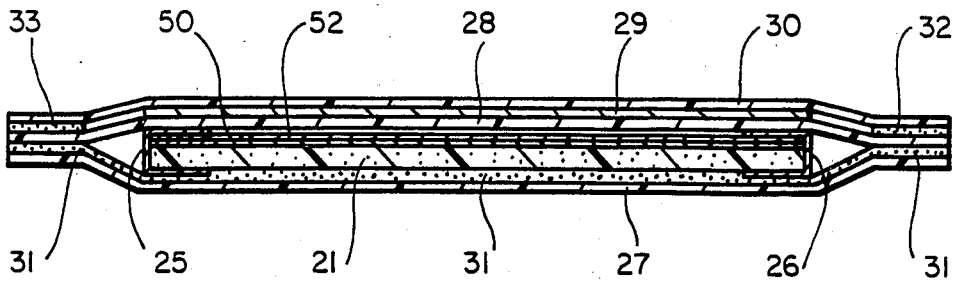
FIG. 11 is a cross-section through another sheet heater according to the sixth and seventh aspect of the invention.
Figure 12:
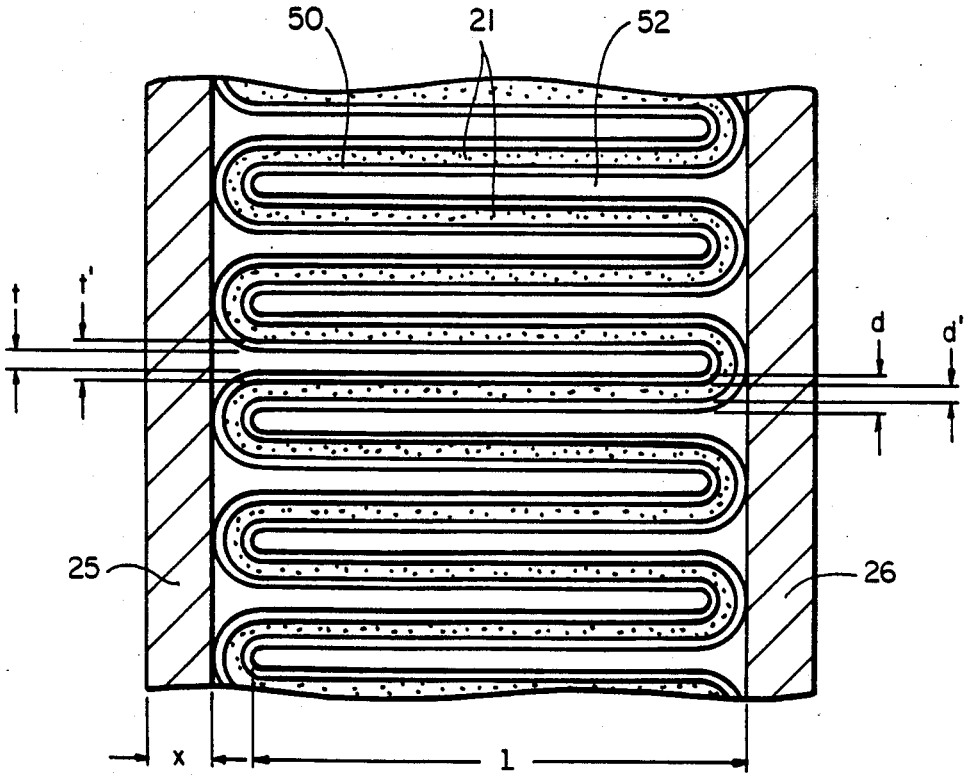
FIG. 12 is a plan view of the heater of FIG. 11.

FIGS. 11 and 12 illustrate a heater similar to that shown in FIGS. 6 and 7. It comprises a heating element comprising a laminar conductive polymer resistive element 21. Printed on the top surface of the resistive element 21 is an interdigitated pattern of a resistive conductive polymer composition 50 which contains carbon black, as the conductive filler, and has substantially lower resistivity than the conductive polymer in the element 21. Printed over the resistive pattern 50 are interdigitated electrodes 52 which are composed of a conductive polymer containing a metal e.g. silver, as the conductive filler and having lower resistivity than the conductive polymer in the resistive pattern 50. The configuration of the electrodes 52 is identical to that of the underprint layer 50, but the electrodes are narrower than the underprint layer. Thus the layer 50 extends between the electrodes 52 and the resistive element 21 and extends slightly beyond the electrodes 52. Bus bars 25 and 26, as used in the device of FIGS. 6 and 7 are provided. An insulating jacket in the form of a polymeric bottom sheet 27 and a polymer top sheet 28 which is secured by adhesive 31 or by a melt bond, is also provided as in the device illustrated in FIGS. 6 and 7, as is a metallic foil 29 which is held in place by polymeric insulating sheet 30 secured to sheet 28 by adhesive layers 32 and 33 or by a melt bond. The width t and length l, of the electrodes 52 are the same as those for the electrodes 22 and 23 illustrated in FIG. 1. the width t' and the separation distance d' of the underprint layer 50 are

| | |
|---|---|
| t' | 0.06–0.4 inch |
| d' | 0.1–0.3 inch |

The invention is further illustrated by the following Examples.

EXAMPLE 1

Heater According to the First Aspect of the Invention

A dispersion of carbon black in an ethylene/ethyl acrylate copolymer (commercially available from Union Carbide as DHDA-7704) was melt-extruded into a sheet 0.015±0.002 inch thick and 18 inches wide. The sheet was irradiated to a dosage of 15 Mrad and the resulting cross-linked sheet was cut into samples 3×4 inch in size.

Using a thick film ink comprising silver particles and an elastomer (commercially available from Acheson as Electrodag 504SS), an electrode pattern as shown in FIG. 1 was screen-printed onto one face of a number of samples. The ink was cured at 150° F. for 30 minutes. Copper foil termination pads were then secured to the printed electrodes, again as shown in FIG. 1, using a conductive adhesive.

Other samples were converted into heaters by securing copper bus connectors, 0.125 inch wide and 0.003 inch thick to one face of the laminate, and then screen-printing the electrodes on top of the bus connectors and the laminar element (using the same technique as with the previous samples) to give a product as shown in FIG. 3.

Finally a cross-linked polyethylene film was laminated to both sides of the samples and the edges of the polyethylene film heat-sealed to prevent delamination. Contact with the copper bus connectors or termination pads was made by cutting a patch from the insulating film and soldering a lead to the exposed copper, or by means of insulation-piercing clips.

Example 2

Heater According to the Second, Third and Fifth Aspect of the Invention.

A heater as illustrated in FIGS. 1 and 2 was made in the following way.

The ingredients listed below were compounded together and melt-extruded at 450° F. as a sheet 0.0175 inch thick.

| Ingredient | % by weight |
|---|---|
| Polyvinylidene fluoride ("Kynar") | 79.7 |
| Carbon Black (Vulcan XC-72) | 10.2 |
| Fillers and other additives | 10.1 |

The sheet was irradiated to a dose of 14 megarads, thus cross-linking the polymer. The resistivity of the cross-linked compositions at 23° C. was 3,500 ohm.cm. The sheet was then heated and split into strips 7.25 inches wide. An electrode pattern as illustrated in FIG. 1 was deposited on the strips, by screen printing a graphite-and-silver-containing composition onto the strip, followed by drying. The resistivity of the printed composition, after it had dried, was about $10^{-4}$ ohm.cm. The distance (d) between adjacent electrodes was 0.25 inch; the width (t) of each electrode was 0.0625 inch; and the length (1) of each electrode was 5.4 inches.

Bus bars of nickel-coated copper expanded metal, 1.5 inch wide, were folded around the edges of the electrode-bearing strip, and the assembly laminated between (A) a bottom sheet of ethylene-chlorotrifluoroethylene copolymer ("Halar") 8.5 inch wide and 0.020 inch thick, coated on the whole of its top surface with a layer 0.002 inch thick of a silicone adhesive sold by Adhesives Research Corporation under the trade name "Arclad", and (B) a top sheet of ethylene-chlorotrifluoroethylene ("Halar") 8.5 inch wide and 0.010 inch thick, placed in contact with the printed electrodes, which was coated on 0.5 inch wide edge portions of its bottom surface with a layer 0.002 inch thick of the same adhesive. Lamination was carried out at 125° F. and 100 psi. There was no adhesive between the top sheet and the bus bars, or between the top sheet and the conductive polymer sheet, or between the top sheet and the electrodes. A sheet of copper, 0.002 inch thick and 7.25 inch side, was placed on the exposed surface of the top sheet, and an outer sheet of ethylene-chlorotrifluoroethylene ("Halar"), 8.5 inch wide and 0.005 inch thick, was placed over the copper sheet and laminated (at 125° F. and 100 psi) to the edge portions of the bottom sheet (but not the copper foil), through 0.5 inch wide layers of 0.002 inch thick "Arclad" adhesive on edge portions of the outer sheet. There was no adhesive between the outer sheet and the copper foil.

EXAMPLE 3

Heater According to the Fourth Aspect of the Invention.

A heater as illustrated in FIGS. 8 and 9 was made in the following way.

The ingredients listed below were compounded together and melt extruded at 450° F. as a sheet 0.0175 inch thick.

| Ingredient | % by weight |
|---|---|
| polyvinylidene fluoride ("Kynar") | 79.7 |
| carbon black (Vulcan XC72) | 10.2 |
| fillers and other additives | 10.1 |

The sheet was irradiated to a dose of 14 Mrads (7 Mrads each side) thus cross-linking the polymer. An electrode pattern as illustrated in FIG. 9 was deposited on the strips by screen printing a layer comprising a graphite and silver containing composition, having a resistivity of $1.3\times10^{-2}$ ohm.cm, followed by drying. The distance (d) between adjacent electrodes was 0.25 inch; the width (t) of each electrodes was 0.0625 inch, and the length (1) of each electrode was 5.4 inch. Then the sheet was heated to 175° F. for 1 hour and slit into strips 7.25 inches wide.

8 to 10 mils of a curable two part silicone liquid (Sylgard 577, sold by Dow Corning) were then applied to the strips and the strips were placed in an oven at 275° F. for 5 to 10 minutes to cure the silicone.

Bus bars of nickel-coated copper expanded metal, 1.5 inch wide, were folded around the edges of the electrode-bearing strip, and the assembly laminated between (A) a bottom sheet of ethylenechlorotrifluoroethylene copolymer ("Halar") 8.5 inch wide and 0.020 inch thick, coated on the whole of its top surface with a layer 0.002 inch thick of a silicone adhesive sold by Adhesives Research Corporation under the trade name "Arclad", and (B) a top sheet of ethylene-chlorotrifluoroethylene copolymer ("Halar") 8.5 inch wide and 0.010 inch thick, placed in contact with the dielectric which was coated on 0.5 inch wide edge portions of its bottom surface with a layer 0.002 inch thick of the same adhesive. Lamination was carried out at 125° F. and 100 psi. There was no adhesive between the top sheet and the bus bars, or between the top sheet and the electrodes or between the top sheet and the dielectric layer. A sheet of copper, 0.002 inch thick and 7.25 inch wide, was placed on the exposed surface of the top sheet, and an outer sheet of ethylene-chlorotrifluoroethylene copolymer ("Halar"), 8.5 inch wide and 0.005 inch thick, was placed over the copper sheet and laminated (at 125° F. and 100 psi) to the edge portions of the bottom sheet (but not the copper foil), through 0.5 inch wide layers of 0.002 inch thick "Arclad" adhesive on edge portions of the outer sheet. There was no adhesive between the outer sheet and the copper foil.

EXAMPLE 4

Heater According to the Fifth Aspect of the Invention.

A heater as illustrated in FIG. 11 was made in a same way to the heater illustrated in FIGS. 6 and 7 as described in Example 2, except that before the electrode pattern was deposited on the strips, an underprint layer comprising a graphite containing composition, having a resistivity of about 0.1 ohm.cm, i.e., intermediate between the resistivity of the resistive element and the electrodes, was deposited on the strips by screen printing, and then dried. The electrodes were then screen printed directly to overlie the underprint layer. The interdigitated portions of the underprint layers were twice as wide as the electrodes. Thus the width (t) of each electrode was 0.0625 inch and the width (t') of each of the interdigitated portions of the underprint layer was 0.125 inch. The distance (d') between adjacent interdigitated portions of the underprint layer was 0.25 inch.

We claim:

1. An electrical sheet heater which comprises:

(1) a laminar resistive element which is composed of a conductive polymer composition which comprises an organic polymer, and dispersed in the polymer, a particulate filler;

(2) a plurality of electrodes at least two of which can be connected to a source of electrical power to cause current to pass through the laminar element, and which are dimensioned and positioned on a surface of the element so that when current passes between the electrodes, a substantial proportion of the current is parallel to the faces of the laminar element; and (3) a dielectric layer positioned over at least part of the electrodes, the dielectric layer having been applied directly onto the electrodes in liquid form, and then solidified so that a solidified layer is formed having a first surface which is intimately bonded to at least part of the electrodes, and a second surface, facing away from the electrodes, with the proviso that if another member is bonded to the second surface of the solidified dielectric layer, at least one of the following conditions is satisfied (a) the peel strength of the bond between the said another member and the second surface of the dielectric layer is less than the peel strength of the bond between the first surface of the dielectric layer and the electrode; and (b) the peel strength of the bond between the said another member and the second surface of the dielectric layer is less than 3 lbs. per inch at 20° C.

2. A heater according to claim 1 wherein the conductive polymer composition exhibits PTC behavior, the electrodes are on the same surface of the resistive element, and each of the electrodes comprises a plurality of distinct parts which interdigitate with distinct parts of an adjacent electrode.

3. A heater according to claim 1 wherein the dielectric layer has a tensile strength less than 2,000 psi.

4. A heater according to claim 3 wherein the dielectric layer is applied as a composition that will cure without the application of heat.

5. A heater according to claim 1 wherein the dielectric layer comprises a silicone.

6. A heater according to claim 1 wherein the resistive element is composed of a material having a surface energy of less than 35 dynes/cm and the dielectric layer overlies and is intimately bonded to the resistive element.

7. A heater according to claim 6 wherein the resistive element is composed of a conductive polymer composition in which the organic polymer is polyvinylidene fluoride.

8. A heater according to claim 1, wherein the conductive polymer composition exhibits PTC behavior, and has a resistivity at 23° C. in the range 0.5 to 100,000 ohm.cm, and the solidified dielectric layer has a dielectric strength of at least 1 Volt per 0.001 inch at the switching temperature $T_s$ of the conductive polymer composition.

9. A heater according to claim 1, wherein the electrodes were formed by a process comprising printing a conductive ink onto the resistive element.

10. A heater according to claim 1, wherein the dielectric layer overlies and is intimately bonded to at least part of the resistive element.

11. A heater according to claim 1, wherein the dielectric layer extends over only part of the electrodes.

12. A heater according to claim 1 which comprises a laminar polymeric insulating jacket which surrounds the heating element and which is adjacent to, but is not secured to, the electrodes, or the dielectric layer, or to the electrode-bearing face of the resistive element; a laminar metallic member which provides a ground plane for the heater, which is separated from the heating element by the insulating jacket, and which is adjacent to the insulating jacket but is not secured thereto; and an auxiliary laminar insulating member which is secured to the insulating jacket so as to form a pocket having the metallic member moveably contained therein.

13. A heater according to claim 1, which is flexible.

* * * * *